US008468612B1

(12) United States Patent
Galloway

(10) Patent No.: US 8,468,612 B1
(45) Date of Patent: Jun. 25, 2013

(54) SCARF SYSTEM WITH SLEEVE POCKETS

(76) Inventor: Marie A. Galloway, Temecula, CA (US)

( * ) Notice: Subject to any disclaimer, the term of this patent is extended or adjusted under 35 U.S.C. 154(b) by 221 days.

(21) Appl. No.: 13/027,733

(22) Filed: Feb. 15, 2011

(51) Int. Cl.
*A42B 5/00* (2006.01)

(52) U.S. Cl.
USPC ..... 2/207

(58) Field of Classification Search
USPC ..... 2/86, 88, 89, 206, 207, 208, 213, 2/104, 84, 69.5; 5/413 R
See application file for complete search history.

(56) References Cited

U.S. PATENT DOCUMENTS

| | | | | | |
|---|---|---|---|---|---|
| 331,179 | A | * | 11/1885 | Barter | 2/88 |
| 1,157,341 | A | * | 10/1915 | Tallerday | 2/91 |
| 1,197,205 | A | * | 9/1916 | Hindin | 2/207 |
| 1,285,917 | A | * | 11/1918 | Bradley et al. | 2/91 |
| 1,399,523 | A | | 12/1921 | Sable | |
| 1,467,718 | A | * | 9/1923 | Entrikin et al. | 2/88 |
| 1,509,296 | A | * | 9/1924 | Hopewell | 2/88 |
| 1,705,963 | A | * | 3/1929 | Clawson | 2/88 |
| 1,739,433 | A | * | 12/1929 | Young | 2/88 |
| 1,916,068 | A | * | 6/1933 | Nyhagen | 2/88 |
| 2,024,044 | A | * | 12/1935 | Johnson | 2/88 |
| 2,040,029 | A | * | 5/1936 | Smutny | 2/89 |
| 2,180,970 | A | * | 11/1939 | Soldinger | 2/70 |
| 2,213,754 | A | * | 9/1940 | Thirring | 280/810 |
| 2,420,344 | A | | 5/1947 | Alexander | |
| 2,593,059 | A | * | 4/1952 | Schnurer | 2/74 |
| 2,603,788 | A | * | 7/1952 | Page | 2/84 |
| 2,669,721 | A | * | 2/1954 | Koch | 2/88 |
| 2,708,273 | A | * | 5/1955 | Bonaventura | 2/209.11 |
| 2,911,648 | A | * | 11/1959 | Schanda-Seyferth | 2/69 |
| 3,144,660 | A | * | 8/1964 | Portaro | 2/88 |
| 3,590,864 | A | * | 7/1971 | Vechesloff | 135/95 |
| 3,704,469 | A | | 12/1972 | Levy | |
| 4,037,340 | A | * | 7/1977 | Owensmith | 40/586 |
| 4,316,288 | A | * | 2/1982 | Henrickson | 2/88 |
| 4,488,315 | A | * | 12/1984 | Hoerlein | 2/91 |
| 4,559,647 | A | * | 12/1985 | Smith et al. | 2/158 |
| 4,570,267 | A | * | 2/1986 | Appel | 2/91 |
| 4,706,304 | A | * | 11/1987 | Jones | 2/91 |
| 5,611,083 | A | | 3/1997 | Arnold | |
| 5,625,897 | A | * | 5/1997 | Park | 2/69 |
| 5,873,131 | A | * | 2/1999 | Sabin | 2/69 |
| 5,875,492 | A | * | 3/1999 | Moss | 2/93 |
| 6,052,830 | A | * | 4/2000 | Payne | 2/171.1 |
| 6,175,964 | B1 | * | 1/2001 | Adler | 2/207 |
| 6,240,562 | B1 | * | 6/2001 | Martin | 2/88 |
| D449,422 | S | * | 10/2001 | Massie | D2/614 |
| 6,349,411 | B1 | * | 2/2002 | Tyler | 2/69 |
| 6,353,933 | B1 | * | 3/2002 | Love | 2/88 |
| 6,578,204 | B2 | * | 6/2003 | Ozenkoski | 2/86 |
| 6,708,343 | B1 | * | 3/2004 | Ceron | 2/88 |
| 6,859,940 | B1 | * | 3/2005 | Sholander | 2/69 |
| D529,682 | S | | 10/2006 | Strong | |
| 7,222,371 | B2 | * | 5/2007 | Houghton et al. | 2/88 |
| D555,330 | S | * | 11/2007 | Cass et al. | D2/866 |
| 7,467,423 | B1 | | 12/2008 | Tawfik | |
| 7,765,611 | B2 | * | 8/2010 | Marshall et al. | 2/88 |
| 8,225,429 | B2 | * | 7/2012 | Tawfik | 2/207 |
| 2002/0073476 | A1 | * | 6/2002 | Jastrab et al. | 2/88 |
| 2003/0196244 | A1 | * | 10/2003 | Nardi | 2/88 |

(Continued)

*Primary Examiner* — Alissa L Hoey

(57) ABSTRACT

The present invention is a "Scarfie" or scarf with sleeves, which allows a person to wear it in place of a jacket, and would not have to take it off and carry it around when the environment turns warm. The present scarf has sleeves at the ends of the scarf for inserting arms and hugging themselves to keep warm when the weather turns cooler.

5 Claims, 3 Drawing Sheets

U.S. PATENT DOCUMENTS

2004/0237167 A1* 12/2004 Curry ..... 2/88
2005/0039241 A1* 2/2005 Khan ..... 2/86
2005/0039242 A1 2/2005 Edmondson
2005/0044606 A1 3/2005 Flanagan-Frazier
2006/0064795 A1* 3/2006 Houghton et al. ..... 2/88
2007/0006360 A1* 1/2007 Walker ..... 2/88
2007/0033706 A1 2/2007 Kuhlmann
2007/0074329 A1* 4/2007 Marshall et al. ..... 2/69
2008/0047044 A1* 2/2008 Jones ..... 2/84
2008/0271222 A1* 11/2008 Nienow ..... 2/88
2008/0282444 A1* 11/2008 Lin ..... 2/88
2010/0146680 A1* 6/2010 Cuoco ..... 2/84
2010/0325776 A1* 12/2010 Korver ..... 2/158
2011/0055999 A1* 3/2011 Su ..... 2/207
2011/0126339 A1* 6/2011 Auer et al. ..... 2/84
2011/0258749 A1* 10/2011 Hibbs ..... 2/84
2011/0305866 A1* 12/2011 Stowe ..... 428/100
2011/0307992 A1* 12/2011 Martinson ..... 2/69
2012/0005801 A1* 1/2012 Parr ..... 2/84
2012/0079644 A1* 4/2012 Benderradji ..... 2/207
2012/0137416 A1* 6/2012 Taul ..... 2/461

* cited by examiner (Inside ISO View)

(Outside ISO View)

(In-use View)

(In-use View)

(Alternative Embodiment)

(In-use View)

SCARF SYSTEM WITH SLEEVE POCKETS

BACKGROUND OF THE INVENTION

People wear heavy coats and jackets when it's cold, and have to take it off and carry the coats and jackets around when it is hot. The present invention is a "Scarfie" or scarf with sleeves, which allows a person to wear it in place of a jacket, and would not have to take it off and carry it around when the environment turns warm. The present scarf has sleeves at the ends of the scarf for inserting arms and hugging themselves to keep warm when the weather turns cooler.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
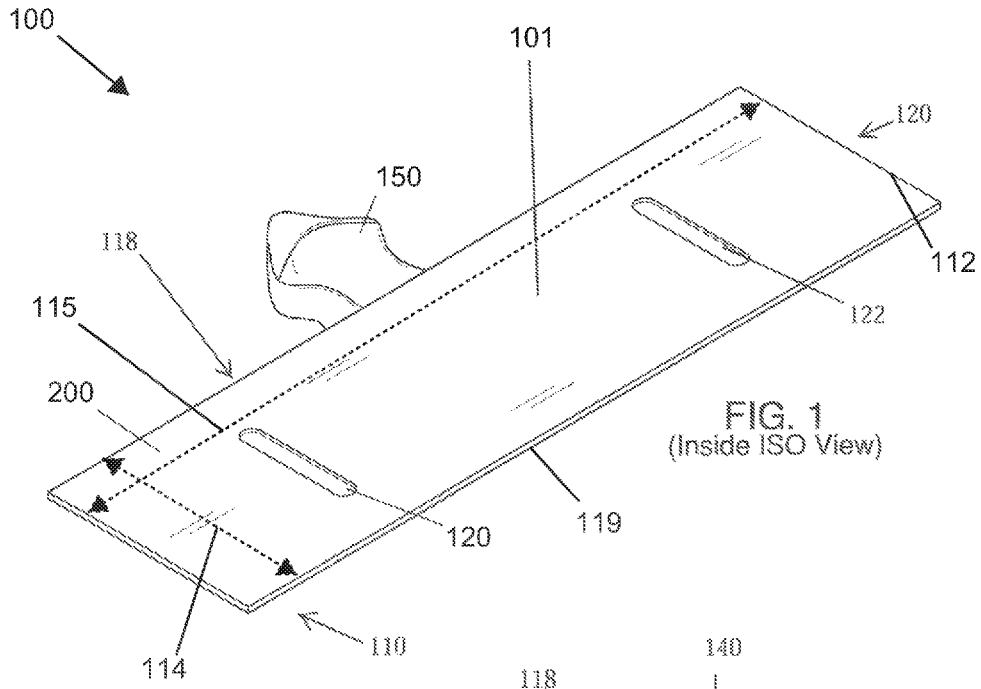
FIG. 1 shows an inside isometric view of the scarf with hood.
Figure 2:
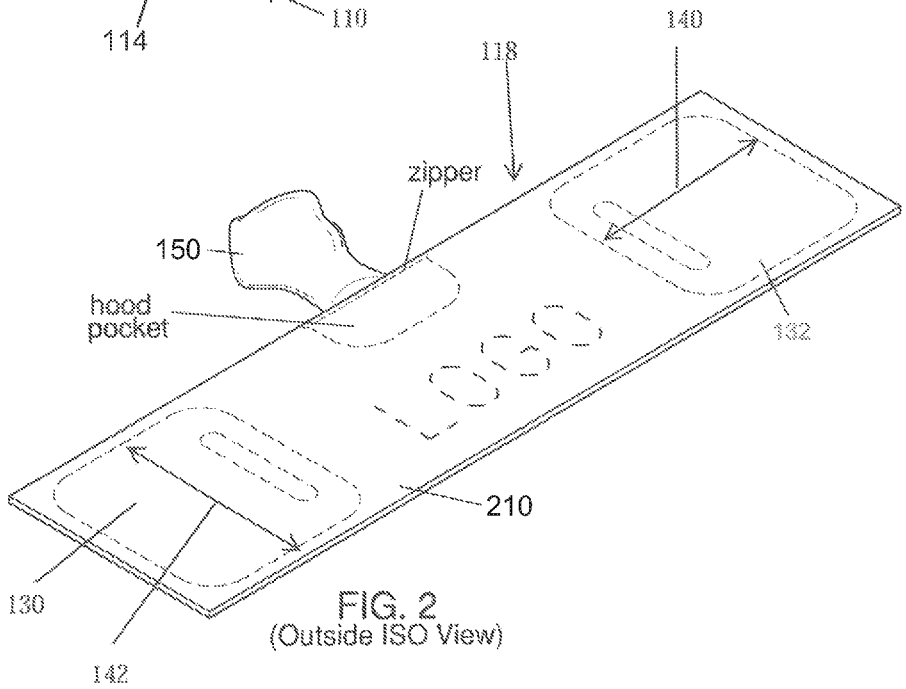
FIG. 2 shows an outside isometric view of the scarf with hood and hood pocket.
Figures 3A, 3B:
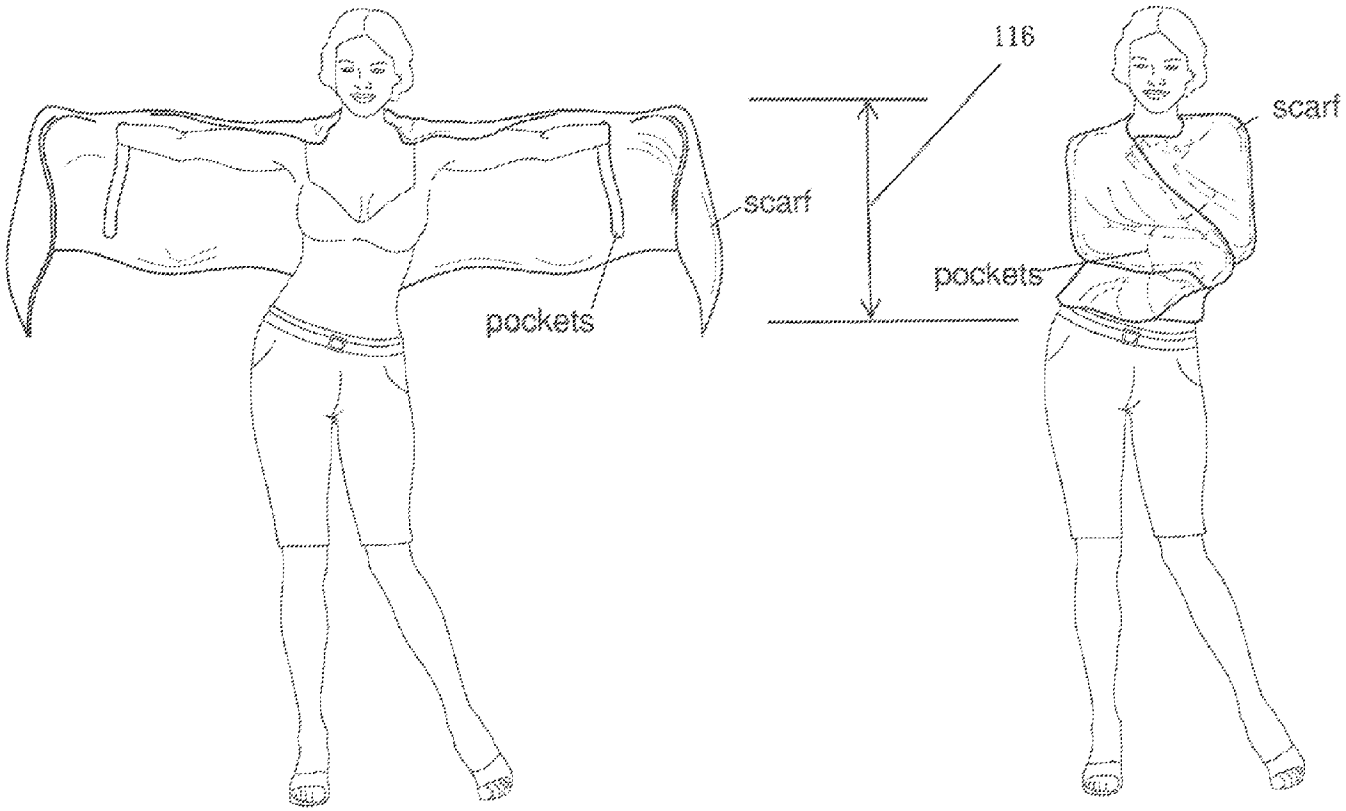
FIG. 3*a* shows a person inserting her arms into the apertures.
FIG. 3*b* shows a person inserting her arms into the apertures and wrapping the scarf around herself.
Figure 4:
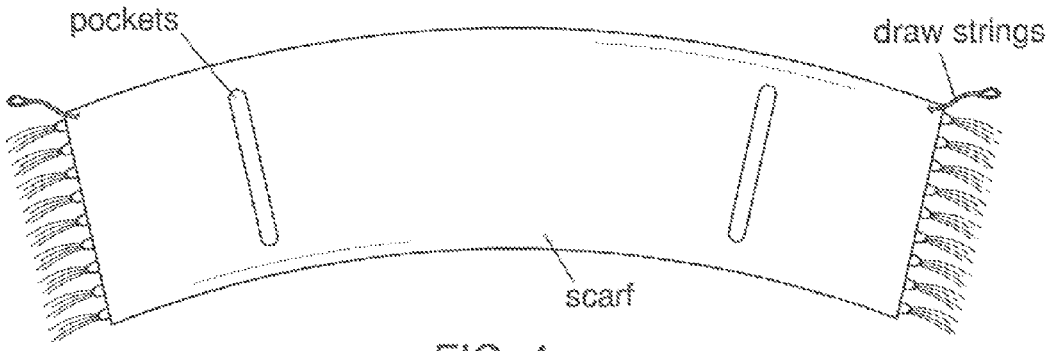
FIG. 4 shows a scarf with draw strings embedded at the top edge.
Figure 5:
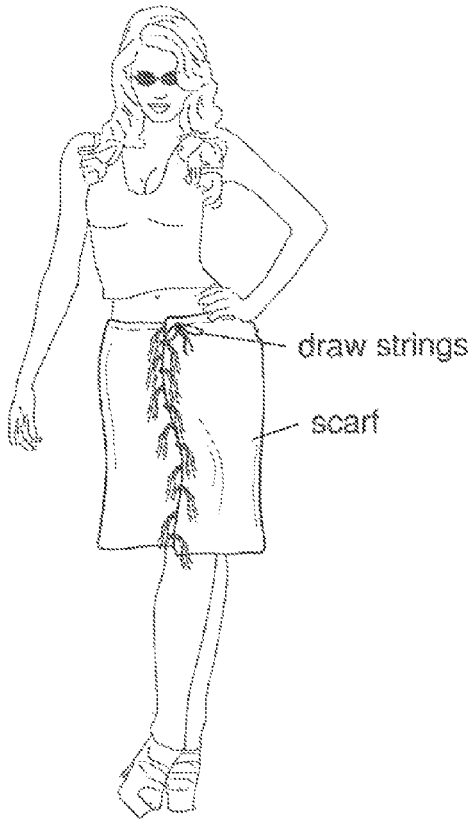
FIG. 5 shows a scarf being wrapped around the waist.

Referring now to FIG. 1-5, the present invention features a rectangular scarf system 100 that can be used in place of a jacket. The scarf system 100 comprises a scarf 101 having a first scarf end 110 and a second scarf end 112. The scarf comprises an inside layer 200, an outside layer 210, a top edge 118, and a bottom edge 119. The scarf has a height 114 of a human torso 116, for example from the shoulder down to the lower back, or in some embodiments about 1 foot to about 2 feet. The scarf has a width 115 from the first scarf end 110 to the second scarf end 112. In some embodiments, the scarf further comprises a first aperture 120 disposed on the inside layer 200 of the scarf toward the first scarf end 110, and also a second aperture 122 disposed on the inside layer 200 of the scarf toward the second scarf end 112. The first aperture 120 allows access to a permanently sealed first sleeve pocket 130 that is formed at the first scarf end 110, and the second aperture 122 allows access to a permanently sealed second sleeve pocket 132 that is formed at the second scarf end 112. Further, the scarf has the following features: (i) the first aperture (120) and the second aperture (122) being the only two access opening into the scarf (101), (ii) the first aperture (120) and second aperture (122) are each independently formed through the inside layer (200), (iii) the first and second sleeve pockets are independently sealed from each other, (iv) the first (130) and second (132) sleeve pockets are independently located between the inside (200) and outside layer (210), and (v) the inside layer (200) forms the first (130) and second (132) sleeve pockets and the inside layer (200) also forms a non-pocket region of the scarf.

In some embodiments, the first and second sleeves 130/132 have a dimension of a depth 140 of at least 16 inches, and a width 142 of at least 17 inches. The dimension of the first and second sleeves can accommodate an insertion of a hand up to an elbow of a person wearing the scarf. For example, when a person wears the scarf 100 around her neck, she'can easily insert her arm up to the elbow into the sleeve.

In some embodiments, the first and second sleeves 130/132 have a dimension of a depth 140 of at least 16 inches, and a width 142 of at least 17 inches. The dimension of the first and second sleeves can accommodate an insertion of a hand up to an elbow of a person wearing the scarf. For example, when a person wears the scarf 100 around her neck, she can easily insert her arm up to the elbow into the sleeve.

In some embodiments, the scarf 100 further comprises a hood 150 disposed at a top edge 118. In some embodiments, the scarf 100 further comprises a hood 150 disposed at a top edge 118 of the scarf as well as a hood pocket 152 for storing the hood 150. In some embodiments, the scarf 100 further comprises a drawstring 160 embedded along a top edge 118 of the scarf.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A scarf system (100) comprising:

(a) a rectangular scarf (101) having an inside layer (200), an outside layer (210), a top edge (118), a bottom edge (119), a first scarf end (110) and a second scarf end (112);

wherein the scarf comprises a height (114) from the top edge (118) to the bottom edge (119) between 1 foot and 2 feet, and a width (115) from the first scarf end (110) to the second scarf end (112); and (b) a first aperture (120) disposed on the inside layer (200) of the scarf (101) toward the first scarf end (110), a second aperture (122) disposed on the inside layer (200) of the scarf (101) toward the second scarf end (112);

wherein the first aperture (120) allows access to a permanently sealed first sleeve pocket (130) that is formed at the first scarf end (110), and the second aperture (122) allows access to a permanently sealed second sleeve pocket (132) that is formed at the second scarf end (112);

wherein the first sleeve pocket (130) and second sleeve pocket (132) each has a depth (140) of at least 16 inches, and a width (142) of at least 17 inches, wherein the first sleeve pocket (130) and second sleeve pocket (132) can accommodate an insertion of a hand up to an elbow of a person wearing the scarf (101), wherein (i) the first aperture (120) and the second aperture (122) being the only two access opening into the scarf (101), (ii) the first aperture (120) and second aperture (122) are each independently formed through the inside layer (200), (iii) the first and second sleeve pockets are independently sealed from each other, (iv) the first (130) and second (132) sleeve pockets are independently located between the inside (200) and outside layer (210), and (v) the inside layer (200) forms the first (130) and second (132) sleeve pockets and the inside layer (200) also forms a non-pocket region of the scarf.

2. The scarf (101) of claim 1 further comprising a hood (150) disposed at the top edge (118).

3. The scarf (101) of claim 1 further comprising a hood pocket (152) for storing a hood (150).

4. The scarf of claim 1 further comprising a drawstring (160) embedded along the top edge (118) of the scarf (101).

5. A scarf system (100) consisting of:

(a) a rectangular scarf (101) having an inside layer (200), an outside layer (210), a top edge (118), a bottom edge (119), a first scarf end (110) and a second scarf end (112);

wherein the scarf consists of a height (114) from the top edge (118) to the bottom edge (119) between 1 foot and 2 feet, and a width (115) from the first scarf end (110) to the second scarf end (112); and (b) a first aperture (120) disposed on the inside layer (200) of the scarf (101) toward the first scarf end (110), a second aperture (122) disposed on the inside layer (200) of the scarf (101) toward the second scarf end (112);

wherein the first aperture (120) allows access to a permanently sealed first sleeve pocket (130) that is formed at the first scarf end (110), and the second aperture (122) allows access to a permanently sealed second sleeve pocket (132) that is formed at the second scarf end (112);

wherein the first sleeve pocket (130) and second sleeve pocket (132) each has a depth (140) of at least 16 inches, and a width (142) of at least 17 inches, wherein the first sleeve pocket (130) and second sleeve pocket (132) can accommodate an insertion of a hand up to an elbow of a person wearing the scarf (101), and wherein (i) the first aperture (120) and the second aperture (122) being the only two access opening into the scarf (101), (ii) the first aperture (120) and second aperture (122) are each independently formed through the inside layer (200), (iii) the first and second sleeve pockets are independently sealed from each other, (iv) the first (130) and second (132) sleeve pockets are independently located between the inside (200) and outside layer (210), and (v) the inside layer (200) forms the first (130) and second (132) sleeve pockets and the inside layer (200) also forms a non-pocket region of the scarf.

* * * * *